US005098284A

United States Patent [19]

van der Veen

[11] Patent Number: 5,098,284

[45] Date of Patent: Mar. 24, 1992

[54] PREMIX GAS BURNER HAVING A HIGH TURN DOWN RATIO

[75] Inventor: Geuko van der Veen, Deventer, Netherlands

[73] Assignee: VEG-Gastinstituut N. V., Apeldoorn, Netherlands

[21] Appl. No.: 715,350

[22] Filed: Jun. 14, 1991

[30] Foreign Application Priority Data

Jun. 15, 1990 [NL] Netherlands ..... 9001366

[51] Int. Cl.[5] ..... F23D 14/82

[52] U.S. Cl. ..... 431/346; 431/158; 431/266; 431/349

[58] Field of Search ..... 431/158, 266, 264, 346, 431/349

[56] References Cited

U.S. PATENT DOCUMENTS 2,880,792 4/1959 Raskin ..... 431/266

2,992,459 7/1961 Campbell ..... 431/349

3,035,632 5/1962 Ericsson ..... 431/346

*Primary Examiner*—Carroll B. Dority

*Attorney, Agent, or Firm*—Weingarten, Schurgin, Gagnebin & Hayes

[57] ABSTRACT

High turn down ratio burner, comprising a burner housing (1) having a connection (2) for a combustible gas/air mixture and a substantially tubular mixture passage (3) leading to a constricted burner throat or mouth (4), via which passage the burner is connectable to a combustion chamber (7) which is part of a heat exchanger (6) or forms a flue passage leading to such heat exchanger, further comprising a flame arrester (8), which is a flashback preventer, in the form of a porous, gas/air mixture-permeable hollow body covering the entire flow-through area towards the burner throat (4) and arranged with its concave side towards the burner throat (4), at a short distance upstream thereof, a number of constricted auxiliary gas passages (9) being arranged around the burner throat.

10 Claims, 1 Drawing Sheet

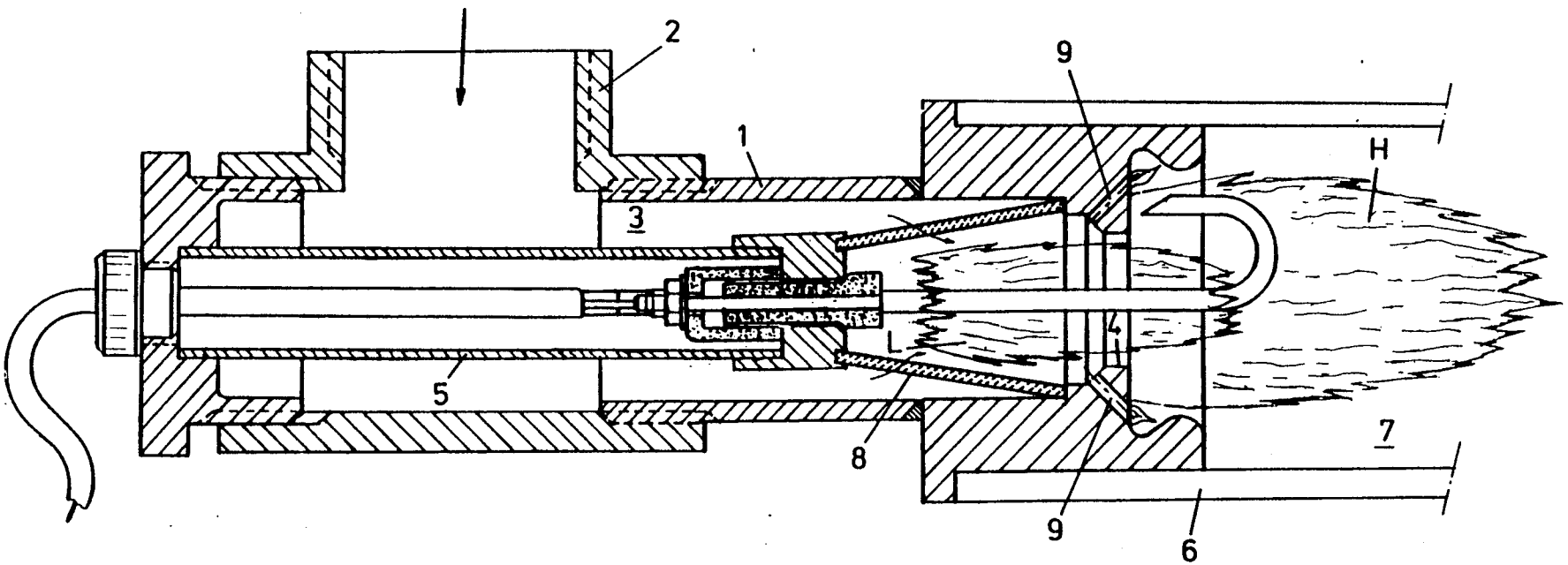
H
7
6
9
9
4
L
8
1
2
3
5

PREMIX GAS BURNER HAVING A HIGH TURN DOWN RATIO

This invention relates to a gas burner, in particular a natural-gas burner, which is suitable, among other things, for heating a liquid bath by means of a compact heat exchanger. Netherlands patent application No. 89 02968 describes an example of such a heat exchanger for heating liquids, which, due to its form and dimensions, is exchangeable with an electric heating element conventionally used for this purpose.

In particular when such a heat exchanger is of compact design, the burner must meet special requirements.

The heat exchangers often provide a high counter pressure to the connected burner. Furthermore, during operation the flame must have a short length. The flame temperature must be high and uniform. Partly because combustion occurs in a space where supplying secondary air is not properly possible, it is desirable for the burner to be of the so-called premix type, i.e. a burner supplied with a substantially stoichiometric gas/air mixture, preferably with a slight air excess.

A burner supplied with a combustible gas/air mixture has the property of being susceptible to flashback, which occurs when the outflow rate of the combustible mixture falls below the combustion rate of the mixture. On the other hand, it is generally a property of gas burners that the flame is blown off and finally extinguished when the outflow rate of the combustible mixture exceeds the combustion rate of the gas mixture. In a theoretically completely stoichiometric mixture the critical outflow rate is so low that the margin between blowing off on the one hand and the occurrence of flashback on the other, is small. Therefore, a premix burner generally has a low turn down ratio. This applies in particular to natural-gas burners because natural gas burns up relatively slowly and accordingly a natural-gas flame is easily blown off.

Moreover, the turn down ratio is further limited if the burner is to function under the conditions described in the foregoing, namely when used in combination with a compact heat exchanger which provides a high counter pressure, the risk of flashback being high, particularly during ignition.

The object of the invention is to provide a premix burner in which the disadvantages mentioned are avoided, i.e. a burner that has a high turn down ratio, is suitable for uses including high counter pressure and further has a large capacity per unit of burner area, while permitting proper combustion of natural gas with little CO, $NO_x$ and $CH_4$ production at a slight air excess.

To that effect, according to the invention the burner comprising a burner housing having a connection for a combustible gas/air mixture and a substantially tubular mixture passage leading to a constricted burner throat or mouth, via which passage the burner can be connected to a combustion chamber which is part of a heat exchanger or forms a flue passage leading to a heat exchanger, is characterized by a flame arrester, which is a flashback preventer, in the form of a porous, gas/air mixture-permeable hollow body covering the entire flow-through area towards the burner throat and arranged with its concave side towards the burner throat, at a short distance upstream thereof, a number of constricted auxiliary gas passages being provided around the burner throat.

Flame arresters in gas burners are known in many forms. They can be designed as bodies of wire mesh, perforate ceramic material, a group of small pipes, and the like. Their effect is based on the creation of a temperature difference between the lower temperature on the supply side and the higher temperature on the flame side, such that on the supply side the temperature remains below the ignition temperature of the mixture.

Also known is the provision of auxiliary gas passages parallel to a burner throat so as to allow a part of the combustible mixture to flow out through the burner throat at a lower rate than the main stream in order to stabilize a flame that shows a tendency to be blown off and burns turbulently.

The auxiliary gas passages as used according to the invention in combination with a specific flame arrester, also have the function of increasing the capacity and the turn down ratio of the burner. Indeed, they stabilize the flame at high outputs, but at lower loads, when the flame can withdraw into the burner throat, they still have a stabilizing influence. The auxiliary gas passages do not lose their function until the flame has withdrawn upstream of the burner throat, more particularly within the flame arrester, which is possible by virtue of the specific design of the flame arrester, which can also function as a flame holder, i.e. as a flame positioning means.

In that situation, i.e. at a very low load, to prevent any mixture from flowing around the flame arrester via the auxiliary gas passages behind the flame, according to a preferred embodiment of the invention the flame arrester may also cover the mixture flow-through area towards the inlets of the auxiliary passages. Thus, at high loads, the auxiliary gas passages are supplied exclusively with mixture that has passed the flame arrester. At low loads, all mixture supplied is burned within the flame arrester, which increases the turn down ratio in downward direction. Moreover, it is thereby prevented that at lower loads flashbacks occur through the auxiliary gas passages.

The auxiliary gas passages may be in the form of narrow channels extending through the wall of the burner throat or may be designed as slots in the wall of the burner throat.

According to the invention, a flame arrester that is also capable of functioning as a flame positioning means, has a generally conical configuration diverging downstream. A flame is positioned in this flame arrester at the place where the flow rate of the mixture is equal to the combustion rate.

In a particular embodiment the flame arrester is made of metal foam. Good results have been obtained with constructions of nickel foam with a pore density of 45 per inch and a wall thickness of 3 mm. Good results have also been achieved with silicon-carbide foam constructions.

To clarify the invention, one embodiment of the premix burner will now be described, by way of example, with reference to the accompanying drawing.

The drawing schematically shows a longitudinal section of the burner.

According to the drawing, the burner comprises a burner housing 1 with a mixture supply connection 2. The burner housing comprises a mixture passage 3 leading to a constricted throat 4. In the burner housing a known per se ignition device 5 is shown, extending centrally through the housing 1. In the embodiment shown, the burner is connected to a heat exchanger 6 bounding a combustion chamber 7. The drawing further shows a conical flame arrester 8 and auxiliary passages 9.

The operation of the burner is as follows:

The mixture supplied via the connection 2 flows through the mixture passage 3 and is forced to flow through the flame arrester 8. At very low mixture supply pressure, the flame will be positioned within the flame arrester, as indicated by the short flame "L". Assuming that a flame will burn at the place where the mixture supply rate equals the combustion rate of the mixture and taking into account that when the mixture is supplied uniformly and axially through the wall of a diverting body, the rate will be smaller according as the diameter of the body is greater, fluctuations in the supply rate and in the combustion rate are compensated within the conical flame arrester.

When the supply rate of the combustible mixture increases, the flame will move downstream and finally pass the throat 4, as indicated for high rates at "H". The flame then burning turbulently will be stabilized by gas flowing through the auxiliary gas passages 9 at reduced speed.

I claim:

1. A burner comprising a burner housing (1) having a connection (2) for a combustible gas/air mixture and a substantially tubular mixture passage (3) leading to a constricted burner throat or mouth (4), through which passage (3) the burner can be connected to a combustion chamber (7) which is part of a heat exchanger (6) or forms a flue passage leading to a heat exchanger, characterized by a flame arrester (8), which is a flashback preventer, in the form of a porous, gas/air mixture-permeable hollow body covering the entire flow-through area towards the burner throat (4) and arranged with its concave side towards the burner throat (4), at a short distance upstream thereof, a number of constricted auxiliary gas passages (9) being provided around the burner throat (4).

2. A burner according to claim 1, characterized in that the flame arrester (8) also covers the mixture flow-through area towards inlets of auxiliary gas passages (9).

3. A burner according to claim 1, characterized in that the flame arrester (8) has a generally conical configuration diverging downstream.

4. A burner according to claim 1, characterized in that the flame arrester (8) is made of metal foam of such properties that it can function as a flame positioning means at low burner loads.

5. A burner according to claim 4, characterized in that the flame arrester (8) is made of nickel foam of a pore density of 45 per linear inch.

6. A burner according to claim 5, characterized in that the flame arrester (8) has a passage area of 90% at a nickel foam thickness of 3 mm.

7. A burner according to claim 1, characterized in that the flame arrester (8) is made of silicon-carbide foam.

8. A burner according to claim 2, characterized in that the flame arrester (8) has a generally conical configuration diverging downstream.

9. A burner according to claim 2, characterized in that the flame arrester (8) is made of metal foam of such properties that it can function as a flame positioning means at low burner loads.

10. A burner according to claim 3, characterized in that the flame arrester (8) is made of metal foam of such properties that it can function as a flame positioning means at low burner loads.

* * * * *

UNITED STATES PATENT AND TRADEMARK OFFICE

CERTIFICATE OF CORRECTION

PATENT NO. : 5,098,284

DATED : March 24, 1992

INVENTOR(S) : Geuko van der Veen

It is certified that error appears in the above-identified patent and that said Letters Patent is hereby corrected as shown below:

Column 1, line 50, "including" should read --involving--.

Column 3, line 14, "diverting" should read --diverging--.

Signed and Sealed this

Sixth Day of July, 1993

Michael K. Kirk

*Attest:*

MICHAEL K. KIRK

*Attesting Officer*

*Acting Commissioner of Patents and Trademarks*